United States Patent [19]

Horodysky

[11] Patent Number: 4,549,974

[45] Date of Patent: Oct. 29, 1985

[54] LUBRICANTS CONTAINING SULFURIZED ORGANIC ACID DIAMINE SALTS

[75] Inventor: Andrew G. Horodysky, Cherry Hill, N.J.

[73] Assignee: Mobil Oil Corporation, New York, N.Y.

[21] Appl. No.: 535,132

[22] Filed: Sep. 23, 1983

[51] Int. Cl.[4] ..... C10M 1/32

[52] U.S. Cl. ..... 252/33.6; 252/47.5; 252/48.6; 260/398; 562/432; 562/598

[58] Field of Search ..... 252/33.6, 48.6, 47.5; 260/398; 562/432, 598

[56] References Cited

U.S. PATENT DOCUMENTS

| | | | |
|---|---|---|---|
| 2,421,631 | 6/1947 | Lincoln | 252/33.6 |
| 3,755,176 | 8/1973 | Kinney et al. | 252/33.6 |
| 4,201,684 | 5/1980 | Malec | 252/48.6 |
| 4,328,112 | 5/1982 | Vis et al. | 252/47.5 |

*Primary Examiner*—Jacqueline V. Howard

*Attorney, Agent, or Firm*—Alexander J. McKillop; Michael G. Gilman; Van D. Harrison, Jr.

[57] ABSTRACT

The invention provides certain salts of sulfurized carboxylic acids and diamines and their use as friction reducing additives in lubricants or fuels. They are also antioxidants and useful in operations where an additive not corrosive to copper is required.

25 Claims, No Drawings

LUBRICANTS CONTAINING SULFURIZED ORGANIC ACID DIAMINE SALTS

BACKGROUND OF THE INVENTION

1. Field of the Invention

The invention relates to lubricant compositions. More particularly, it relates to a group of salts of sulfurized acids and diamines and to their use in lubricants and fuels as multipurpose additives. The invention is especially concerned with internal combustion engines.

2. Discussion of Related Art

As those skilled in this art know, additives impart special properties to lubricants. They may give the lubricants new properties or they may enhance properties already present. One property all lubricants have in common is the reduction of friction between materials in contact. Nonetheless, the art constantly seeks new materials to enhance the friction properties of the lubricant.

A lubricant, even without additives, when used in an internal combustion engine, for example, will not only reduce friction, but in the process will also reduce consumption of the fuel required to run it. When oils appeared to be inexhaustable, and cheap, some attention was given to increasing frictional properties. Although most of the advances in this area came as a result of additives being placed in lubricants for other purposes, recent events have spurred research programs designed specifically to find materials capable of reducing friction.

The use of amides in lubricants and liquid fuels is known (See U.S. Pat. No. 3,884,822, for example, which discloses lubricants containing the product or reaction between an aminopyridine and oleic acid) but no art teaches or suggests that the salts of this invention are useful for the purposes disclosed herein.

SUMMARY OF THE INVENTION

In accordance with the invention, there are provided products prepared by forming a salt from sulfurized organic carboxylic acids and diamines. There are also provided lubricant and liquid fuel compositions containing a major proportion of a lubricant or fuel and a friction reducing amount of said product. The sulfur-containing additives may also reduce wear and fuel consumption while reducing friction. These phenomena are believed to be due to the sulfur-carboxylate amine salt moiety which possesses great surface activity, and thus affinity for the metallic wearing surfaces.

DESCRIPTION OF SPECIFIC EMBODIMENTS

The sulfurized carboxylic acid can be prepared by methods known in the prior art. I prefer in the practice of my invention to carry out the sulfurization using elemental sulfur at from about 80° C. to about 250° C., preferably about 140° C. to about 200° C. Thus, the sulfurized acid can be prepared by reacting the acid with sulfur in molar ratios ranging from about 2:1 to about 40 to 50:1, respectively, for from 2 to 24 hours. However, other sulfurizing agents, such as the sulfur halides $S_2Cl_2$ and $SCl_2$, may also be used as sulfurizing agents. The final products containing a wide range of sulfur are capable of providing the advantages disclosed herein.

Although the reaction is generally performed in the absence of a solvent, a hydrocarbon solvent can often be used.

The acids useful herein have the formula $$R—COOH$$

wherein R is a $C_{10}$ to $C_{20}$ hydrocarbyl group, preferably an unsaturated group. Included within this definition are oleic acid, linoleic acid, linolenic acid, heptadecenoic acid, unsaturated tall oil acids, tetradecenoic acid, dodecenoic acid, similar unsaturated acids and mixtures of these.

The diamines that may be used have the formula $$R^2—\underset{\underset{R^3}{|}}{N}—R^1—NHR^3$$

wherein $R^1$ is a $C_2$ to $C_4$ hydrocarbylene group, $R^2$ is a $C_{12}$ to $C_{30}$ hydrocarbyl group and $R^3$ is hydrogen or a $C_1$ to $C_6$ hydrocarbyl group. $R^3$ is preferably hydrogen. It will be understood that hydrocarbyl and hydrocarbylene include alkyl, alkenyl, alkylene and alkenylene groups, as well as aryl, alkaryl, aralkyl and cycloalkyl groups. The aryl portion will have from 6 to 14 carbon atoms and embrace the phenyl, naphthyl and anthryl groups.

The reaction to form the salt is carried out at relatively low temperatures. Reaction temperatures are not critical in the true sense of the word, but they must be maintained low enough, and for a time that will not allow the formation of significant amounts of amides or other condensation products. These two factors will, of course, vary with the reactants, but in general the temperature should be in the range of from about 20° C. to about 120° C., preferably about 40° C. to about 80° C. and the time from about ¼ hour to about 2 hours.

Hydrocarbon solvents, or other inert solvents may be used in the reaction, although they are not generally required. Included among the useful solvents are benzene, toluene and xylene. In general, any hydrocarbon solvent, may, if required, be used in which the reactions are soluble and which can, if desired, be easily removed from soluble products.

In carrying out the reaction, the molar ratio of diamine to sulfurized acid will range from about 1:1 to about 1:4, preferably from about 1:2.5 to about 1:1.5.

Some of the useful amines include tallow-1,3-propylenediamine, oleyl-1,3-propylenediamine, stearyl-1,3-propylenediamine, isostearyl-1,3-propylenediamine, soya-1,3-propylenediamine, hydrogenerated tallow-1,3-propylenediamine, dodecyl-1,3-propylenediamine, hexadecyl-1,3-propylenediamine, lauryl-1,3-propylenediamine, heptadecyl-1,3-propylenediamine, coco-1,3-propylenediamine, and mixtures of two or more of these. N-alkyl-1,2-ethanediamines such as N-oleyl-1,2-ethanediamine can also be used.

An important feature of the invention is the ability of the additive to improve the resistance to oxidation of oleaginous materials such as lubricating oils, either a mineral oil or a synthetic oil, or mixtures thereof, or a grease in which any of the aforementioned oils are employed as a vehicle. In general, mineral oils, both paraffinic, naphthenic and mixtures thereof, employed as a lubricating oil or as the grease vehicle, may be of any suitable lubricating viscosity range, as for example, from about 45 SSR at 100° F. to about 6000 SSU at 100°

F., and preferably from about 50 to about 250 SSR at 210° F. These oils may have viscosity indexes ranging to about 100 or higher. Viscosity indexes from about 70 to about 95 are peferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may included any of the conventional metal salts or soaps, which are dispersed in the lubricating vehicle in grease-forming quantities in an amount ot impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other aspects, any material which is normally employed for thickening or gelling hydrocarbon fluids for forming grease can be used in preparing the aforementioned improved grease in accordance with the present invention.

Synthetic oils that may be used per se as the lubricant or as a grease vehicle include polyisobutylenes, polybutenes, hydrogenated polydecenes, polypropylene glycol, polyethylene glycol, trimethylol propane esters, neopentyl and pentaerythritol esters, di(2-ethylhexyl)-sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes) and alkyl-substituted diphenyl ethers typified by a butyl-substituted bis(p-phenoxy phenyl)ether, phenoxy phenylethers.

It is to be understood that the lubricant and fuel compositions contemplated herein can also contain other materials. For example, other corrosion inhibitors, extreme pressure agents, viscosity index improvers, coantioxidants, antiwear agents and the like can be used. These include, but are not limited to, phenates, sulfonates, succinimides, zinc dialkyl dithiophosphates, and the like. These materials do not detract from the value of the compositions of this invention; rather the materials serve to impart their customary properties to the particular compositions in which they are incorporated.

Mineral oil heat exchange fluids particularly contemplated in accordance with the present invention have, among others, the following characteristics of high thermal stability, high initial boiling point, low viscosity, high heat-carrying ability and low corrosion tendency.

Further, the transmission fluids of consequence to the present invention are blends of highly refined petroleum base oils combined with viscosity index improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2; RR 1005 on "Automatic Transmission Fluid/Power Transmission Fluid Property and Performance Definitions." Specifications for low-temperature and aircraft fluids are defined in U.S. Government Specification MIL-H-5606A.

In addition, the oxidation and corrosion resistance of functional fluids such as hydraulic fluids can be improved by the adducts of the present invention.

The products of this invention can also be employed in liquid hydrocarbon fuels, alcohol fuels or mixtures thereof, including mixtures of hydrocarbons, mixtures of alcohols and mixtures of hydrocarbon and alcohol fuels. Twenty-five pounds to 500 pounds or preferably about 50 to 100 pounds of the product per thousand barrels of fuel may be used. Liquid hydrocarbon fuels include gasoline, fuel oils and diesel oils. Methyl and ethyl alcohols are examples of alcohol fuels.

In general, the reaction products of the present invention may be employed in lubricants in any amount which is effective for imparting the desired degree of friction reduction or antioxidant activity. In these applications, the product is effectively employed in amounts from about 0.1% to about 10% by weight, and preferably from about 1% to about 2% of the total weight of the composition.

The following Examples will present illustrations of the invention. They are illustrative only, and are not meant to limit the invention.

EXAMPLE 1

Sulfurized Oleic Acid

Approximately 560 g of oleic acid and 32 g of sulfur were charged to a 1 liter glass reactor equipped with heater, agitator and provision for nitrogen blanketing. The reactants were heated to 180° C. and held for 2 hours. The temperature was lowered to 145° C. and air replaced the nitrogen atmosphere. At 100° C., the intermediate was filtered through diatomaceous earth.

EXAMPLE 2

Sulfurized Oleic Acid Salt of N-Oleyl-1,3-Propylenediamine

Approximately 180 g of N-oleyl-1,3-propylenediamine (commercially obtained as Duomeen O from Armak Chemical Co.) was placed in a glass reactor and warmed to about 70° C. Approximately 270 g of the product of Example 1 were added and agitation continued for ½ hour at about 70° C.

EXAMPLE 3

Sulfurized Oleic Acid

Approximately 560 g of oleic acid, 16 g of sulfur and 50 g of the product of Example 1 were charged to a 2 liter glass reactor equipped with heater, agitator and provision for nitrogen blanketing. The reactants were heated to about 180° C. and held for 2 hours. Vacuum was applied and the reactor contents were cooled to about 100° C. and then filtered through diatomaceous earth.

EXAMPLE 4

Sulfurized Oleic Acid Salt of N-Oleyl-1,3-Propylenediamine

Approximately 180 g of N-oleyl-1,3-propylenediamine, as defined in Example 2, were placed in a glass reactor and warmed to about 60° C. Approximately 250 g of the product of Example 3 were added and agitation was continued for ½ hour at 60° C.

EXAMPLE 5

Sulfurized Oleic Acid

Approximately 560 g of oleic acid, 8 g of sulfur and 50 g of the product of Example 3 were charged to a 2 liter glass reactor equipped with heater, agitator and provision for nitrogen blanketing. The reactants were heated to about 180° C. and held for 2 hours. Vacuum was applied during cooling and the intermediate was filtered through diatomaceous earth at about 100° C.

EXAMPLE 6

Sulfurized Oleic Acid Salt of N-Oleyl-1,3-Propylenediamine

Approximately 180 g of N-oleyl-1,3-propylenediamine, as taught in Example 2, was placed in a glass reactor and warmed to about 60° C. Approximately 250 g of the product of Example 5 were added and agitation continued for about ½ hour at 60° C.

EXAMPLE 7

Sulfurized Oleic Acid

Approximately 560 g of oleic acid, 4 g of sulfur and 50 g of the product of Example 5 were charged to a 2 liter glass reactor equipped with heater, agitator and provision for nitrogen blanketing. The reactants were heated to 180° C. and held for 2 hours. Vacuum was applied to reactor contents during cooling to 100° C. The intermediate was then filtered through diatomaceous earth.

EXAMPLE 8

Sulfurized Oleic Acid Salt of N-Oleyl-1,3-Propylenediamine

Approximately 180 g of N-oleyl-1,3-propylenediamine, described in Example 1, were placed in a glass reactor and warmed to about 60° C. Approximately 250 g of the product of Example 7 were added and agitation at 60° C. was continued for ½ hours.

EVALUATION OF THE COMPOUNDS

The products were blended into fully formulated synthetic automotive (SAE 5W-30) and mineral automotive (SAE 10W-40) engine oils and evaluated for frictional properties using the Low Velocity Friction Apparatus (LVFA). The additive package in the fully formulated oils contained antioxidant, dispersant and detergent. As shown in Tables 1 and 2, a significant reduction in the coefficients of friction was found using these products as compared to the base blend. This test was also used as a screening test to evaluate the reduction in friction such additives might have when used in fuels burned in internal combustion engines. This test should suggest the reduction in friction of say the piston rings moving against the cylinder walls that have been wetted by the fuel containing the additives.

Description

The Low Viscosity Friction Apparatus (LVFA) is used to measure the coefficient of friction test lubricants under various loads, temperatures, and sliding speeds. The LVFA consists of a flat SEA 1020 steel surface (diameter 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cammomotor arrangement.

Procedure

The rubbing surfaces and 12–13 ml of test lubricants are placed on the LVFA. A 240 psi load is applied and the sliding speed is maintained at 40 ppm at ambient temperature for a few minutes. A plot for coefficients of friction ($U_k$) vs. speed were taken at 240, 300, 400, and 500 psi. Freshly polished steel specimens are used for each run. The surface of the steel is paralled ground to 4 to 8 microinches. The results in Tables 1 and 2 refer to percent reduction in friction compared to the unmodified oil. That is, the formulation mentioned above was tested without the compound of this invention and this became the basis for comparison. The results were obtained at 250° F. and 500 psi.

TABLE 1

Frictional Response of Sulfurized Carboxylates of Alkyl Diamines

| COMPOSITION | Additive Conc., Wt. % | Percent Change or Reduction in Coeffieient of Friction 5 Ft./Min. | 30 Ft./Min. |
|---|---|---|---|
| Base blend-fully formulates SAE 5W-30 synthetic oil (containing detergent/dispersant/inhibitor package | — | 0 | 0 |
| Example 2 plus Base Blend | 2 | 51 | 41 |
| Example 4 plus Base Blend | 2 | 39 | 26 |
| Example 6 plus Base Blend | 2 | 41 | 3 |
| | 1 | 30 | 25 |
| Example 8 plus Base Blend | 2 | 43 | 32 |

TABLE 2

Frictional Response of Sulfurized Carboxylates of Alkyl Diamines

| COMPOSITION | Additive Conc., Wt. % | Percent Change or Reduction in Coefficient of Friction 5 Ft./Min. | 30 Ft./Min. |
|---|---|---|---|
| Base blend-fully formulated SAE 10W-40 mineral oil containing detergent/dispersant/inhibitor package | — | 0 | 0 |
| Example 2 plus Base Blend | 2 | 38 | 27 |
| Example 4 plus Base Blend | 1 | 48 | 37 |
| Example 6 plus Base Blend | 2 | 44 | 26 |
| | 1 | 37 | 20 |
| Example 8 plus Base Blend | 2 | 47 | 37 |
| | 1 | 34 | 19 |

I claim:

1. An acid-amine salt prepared by reacting a sulfurized carboxylic acid of the formula $$R—COOH$$

wherein R is a $C_{10}$ to $C_{20}$ unsaturated hydrocarbyl group, at from about 20° C. to about 120° C., with a diamine of the formula $$R^2—\underset{\underset{R^3}{|}}{N}—R^1—NHR^3$$

wherein $R^1$ is a $C_2$ to $C_4$ hydrocarbylene group, $R^2$ is a $C_{12}$ to $C_{30}$ hydrocarbyl group and $R^3$ is hydrogen or a $C_1$ to $C_6$ hydrocarbyl group, using a molar ratio of sulfurized acid to diamine of from about 1:1 to about 4:1.

2. The salt of claim 1 wherein the acid is sulfurized with sulfur or a sulfur halide.

3. The salt of claim 2 wherein the acid is sulfurized with sulfur.

4. The salt of claim 2 wherein the sulfur halide is sulfur monochloride.

5. The salt of claim 2 wherein the sulfur halide is sulfur dichloride.

6. The salt of claim 1 wherein $R^2$ is alkyl, alkenyl, aryl, aralkyl, alkaryl or cycloalkyl.

7. The salt of claim 1 wherein hydrocarbylene is alkylene or alkenylene.

8. The salt of claim 1 wherein the diamine is tallow-1,3-propylenediamine, oleyl-1,3-propylenediamine, isostearyl-1,3-propylenediamine, soya-1,3-propylenediamine, dodecyl-1,3-propylenediamine, hexadecyl-1,3-propylenediamine, heptadecyl-1,3-propylenediamine, coco-1,3-propylenediamine, stearyl-1,3-propylenediamine, hydrogenated tallow-1,3-propylenediamine, lauryl-1,3-propylenediamine or mixtures thereof.

9. The salt of claim 1 wherein the sulfurized acid is oleic acid sulfurized with sulfur in a molar ratio of acid to sulfur of from about 2:1 to about 16:1, and the diamine is N-oleyl-1,3-propylenediamine.

10. A lubricant composition comprising a major proportion of a lubricating oil or a grease therefrom and a friction reducing amount of an acid-amine salt prepared by reacting a sulfurized carboxylic acid of the formula $$R—COOH$$

wherein R is a $C_{10}$ to $C_{20}$ unsaturated hydrocarbyl group, at from about 20° C. to about 120° C., with a diamine of the formula $$R^2—\underset{\underset{R^3}{|}}{N}—R^1—NHR^3$$

wherein $R^1$ is a $C_2$ to $C_4$ hydrocarbylene group, $R^2$ is a $C_{12}$ to $C_{30}$ hydrocarbyl group and $R^3$ is hydrogen or a $C_1$ to $C_6$ hydrocarbyl group, using a molar ratio of sulfurized acid to diamine of from about 1:1 to about 4:1.

11. The composition of claim 10 wherein the acid is sulfurized with sulfur or a sulfur halide.

12. The composition of claim 11 wherein the acid is sulfurized with sulfur.

13. The composition of claim 11 wherein the acid is sulfurized with sulfur monochloride.

14. The composition of claim 11 wherein the acid is sulfurized with sulfur dichloride.

15. The composition of claim 10 wherein in the salt $R^2$ is alkyl, alkenyl, aryl, aralkyl, alkaryl or cycloalkyl.

16. The composition of claim 10 wherein in the salt hydrocarbylene is alkylene or alkenylene.

17. The composition of claim 10 wherein in the salt the diamine is tallow-1,3-propylenediamine, oleyl-1,3-propylenediamine, isostearyl-1,3-propylenediamine, soya-1,3-propylenediamine, dodecyl-1,3-propylene-diamine, hexadecyl-1,3-propylenediamine, heptadecyl-1,3-propylene-diamine, coco-1,3-propylenediamine, stearyl-1,3-propylenediamine, hydrogenated tallow-1,3-propylenediamine, lauryl-1,3-propylene-diamine or mixtures thereof.

18. The composition of claim 10 wherein in the salt the sulfurized acid is oleic acid sulfurized with sulfur in a molar ratio of acid to sulfur of from about 2:1 to about 16:1, and the diamine is N-oleyl-1,3-propylenediamine.

19. The composition of claim 10 wherein the lubricant in the lubricant composition is (1) a mineral oil, (2) a synthetic oil or a mixture of synthetic oils, (3) a mixture of (1) or (2) and (4) a grease from (1), (2), or (3).

20. The composition of claim 19 wherein the lubricant is a mineral oil.

21. The composition of claim 19 wherein the lubricant is a synthetic oil.

22. The composition of claim 19 wherein the lubricant is a mixture of synthetic oils.

23. The composition of claim 19 wherein the lubricant is the oil of (3).

24. The composition of claim 19 wherein the lubricant is the grease of (4).

25. A method of reducing fuel consumption in an internal combustion engine which comprises the step of lubricating said engine with a composition comprising a major proportion of a lubricating oil and a fuel consumption reducing amount of an acid-amine salt prepared by reacting a sulfurized carboxylic acid of the formula $$R—COOH$$

wherein R is a $C_{10}$ to $C_{20}$ unsaturated hydrocarbyl group, at from about 20° C. to about 120° C., with a diamine of the formula $$R^2—\underset{\underset{R^3}{|}}{N}—R^1—NHR^3$$

wherein $R^1$ is a $C_2$ to $C_4$ hydrocarbylene group, $R^2$ is a $C_{12}$ to $C_{30}$ hydrocarbyl group and $R^3$ is hydrogen or a $C_1$ to $C_6$ hydrocarbyl group, using a molar ratio of sulfurized acid to diamine of from about 1:1 to about 4:1.

* * * * *